United States Patent [19]

Bühler

[11] Patent Number: 4,586,555

[45] Date of Patent: May 6, 1986

[54] MOLD MAKING PLANT

[76] Inventor: Eugen Bühler, Schleifweg 3, 8877 Burtenbach, Fed. Rep. of Germany

[21] Appl. No.: 665,203

[22] Filed: Oct. 26, 1984

[30] Foreign Application Priority Data

Nov. 2, 1983 [DE] Fed. Rep. of Germany ..... 3339620

[51] Int. Cl.[4] ..... B22C 15/24

[52] U.S. Cl. ..... 164/180; 164/201; 164/160.1; 164/375; 164/340

[58] Field of Search ..... 164/200–202, 164/19–22, 7.1, 160.1, 375, 340, 180, 181

[56] References Cited

FOREIGN PATENT DOCUMENTS 87575 9/1983 European Pat. Off. ..... 164/200

2712489 9/1978 Fed. Rep. of Germany ..... 164/201

3008777 9/1980 Fed. Rep. of Germany ..... 164/200

*Primary Examiner*—Kuang Y. Lin

*Attorney, Agent, or Firm*—Jones, Tullar & Cooper

[57] ABSTRACT

A mold making machine the production of flaskless molds is made up of a sand supply container, with a blowing and squeezing grid at its lower, that is able to be moved vertically, a hollow pattern plate mount, valve and duct means connected with the said mount, and drag and cope flasks that are fitted around said sand container for vertical motion in relation thereto. At the start of a mold producing operation the drag flask is placed under the cope flask on the container. This design of the molding machine enables it to be used for the alternate production of flaskless drags and copes which are made into block molds.

8 Claims, 7 Drawing Figures

MOLD MAKING PLANT

BACKGROUND OF THE INVENTION

The present invention relates to mold making plant of the sort comprising a mold making machine for the production of flaskless molds from binder-containing wet-casting foundry sand, that is vacuum-blown into a flask and, if desired, is then further compacted pneumatically by the pulsed air method and is mechanically squeezed to form a mold drag or cope.

A mold making machine operating on this principle is to be seen in the German Pat. No. 2,844,464. However in this patent it was designed as a high-output machine for the repetitive production of identical drags or copes of a given mold so that in practice two such machines have to be employed, one producing the drag and the other the cope.

There are however a number of foundries which are not able to make good use of the high mold production rate offered by such specialized machines and the existing factors and facilities in a foundry such as the rate of output from the furnace or the amount of space available in the factory building, may often make it desirable to produce the drags and copes alternately on one and the same machine, the machine being such that it does not have to have a deep foundation or a machine pit, in order to keep down the initial costs of the plant.

SHORT OVERVIEW OF THE INVENTION

One object of the present invention is to design a mold making plant of the sort in question whose mold making machine lends itself to the alternate production of the sand structures of flaskless drags and copes.

A further aim of the invention is to make possible such a machine that inserts cores before the mold is closed and is transported along a casting and cooling conveyor to a punch-out station.

As part of a still further aim of the invention the plant is to be compact and is to have a low overall height without needing a deep pit and foundation so that it may be utilized in small foundries with low headroom and within the operating range of cranes.

It is also an objective of the invention to design a mold making plant that as far as possible is based on the use of conventional, pre-existing components of proven reliability from different forms of plant so that the development, construction, upkeep and maintenance costs are kept down.

In order to effect these and other objects, in the invention a mold making plant for the production of flaskless molds from foundry sand comprises a sand supply container, a blowing and squeezing grid at a lower end of said container, said grid being able to be moved vertically, a mold making flask, a hollow pattern plate mount, valve and duct means connected with the said hollow mount, said mold-making flask being made up of a cope flask and a drag flask, the cope flask when empty being placed over the drag flask and around said sand container. Further features of the invention claimed herein are designed to make possible advanced automation of operation of the mold producing plant. Such plant is intended to make use of known and proven machine components as described in the German Pat. Nos. 2,923,044, 3,011,265 and 3,020,349.

A more detailed account will now be given of the invention on the basis of the working example thereof to be seen in the accompanying figures.

LIST OF THE SEVERAL VIEWS OF THE DRAWINGS

DETAILED ACCOUNT OF WORKING EXAMPLES OF THE INVENTION

Figure 7:
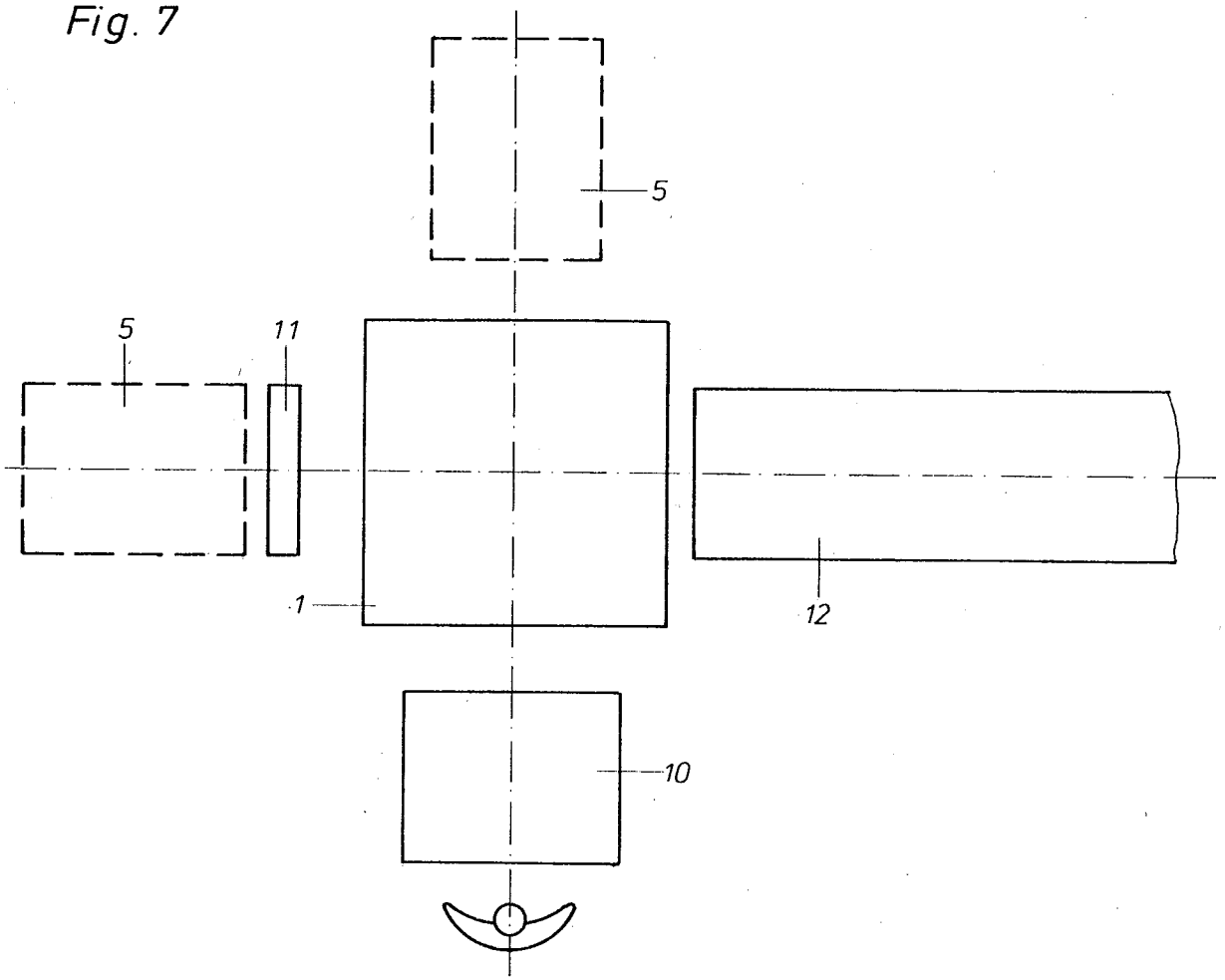
FIG. 7 is a plan view of the mold making plant to show the placing and a possible lay-out of the main elements thereof.

The mold making plant comprises a vacuum blowing machine with a sand container 1, of which at least the lower part may be moved in a vertical direction and which at its lower end has a blowing and squeezing grid 2 that may be obturated and a venturi-like restricted passage thereover. In the initial position, the lower part of the sand container 1 is surrounded by the drag (or lower) flask 3 and the cope (or upper) flask 4, that are superimposed and may be moved vertically in relation to each other by way of their own cylinder actuators that are not shown. There is a hollow pattern plate mount 5 or support placed under the blowing and squeezing grid 2. This mount 5 may be swiveled about a level axis and has pattern plates of each of its sides. The space within the pattern plate mount is walled off by a parting wall 6 into two chambers 7 and 8, that may be filled with compressed air or put under vacuum separately from each other. The pressure in the chamber at a given time causes air to flow through the air holes in the pattern plate and the pattern during the molding operation so that the mold space will be put under pressure or under vacuum as well, as will be readily understood. The pattern plate mount 5 is furthermore able to be shifted on the level into one or other of the possible positions as marked in FIG. 7, such positions depending on the conditions existing in a particular foundry.

Furthermore under the pattern plate mount the mold making machine in the molding stations has a vertically moving table 9 and next to the molding station there is a core placing station 10. The machine is furthermore equipped with a rollover unit that turns the drag flask coming from the mold molding station through 180° before putting it down on the table.

A further part of the plant is constituted by a thrust plate 11, that pushes the block mold ready for casting onto a casting and cooling conveyor that is preferably a roller conveyor 12.

Figure 1:
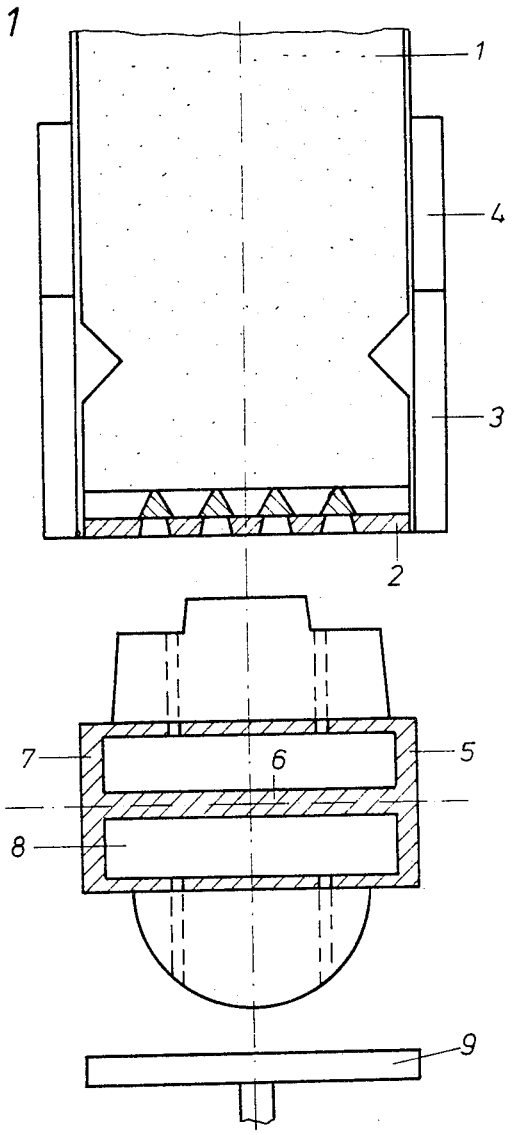
FIG. 1 shows a mold making machine of the invention in the starting position prior to a molding phase and with some of the parts of the plant sectioned.
Figure 2:
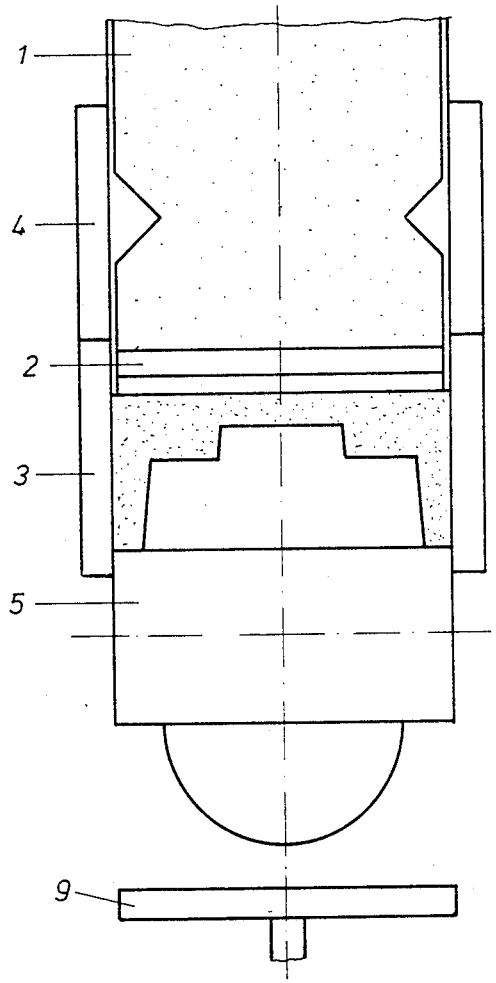
FIG. 2 shows the plant in the position after packing the drag.
Figure 3:
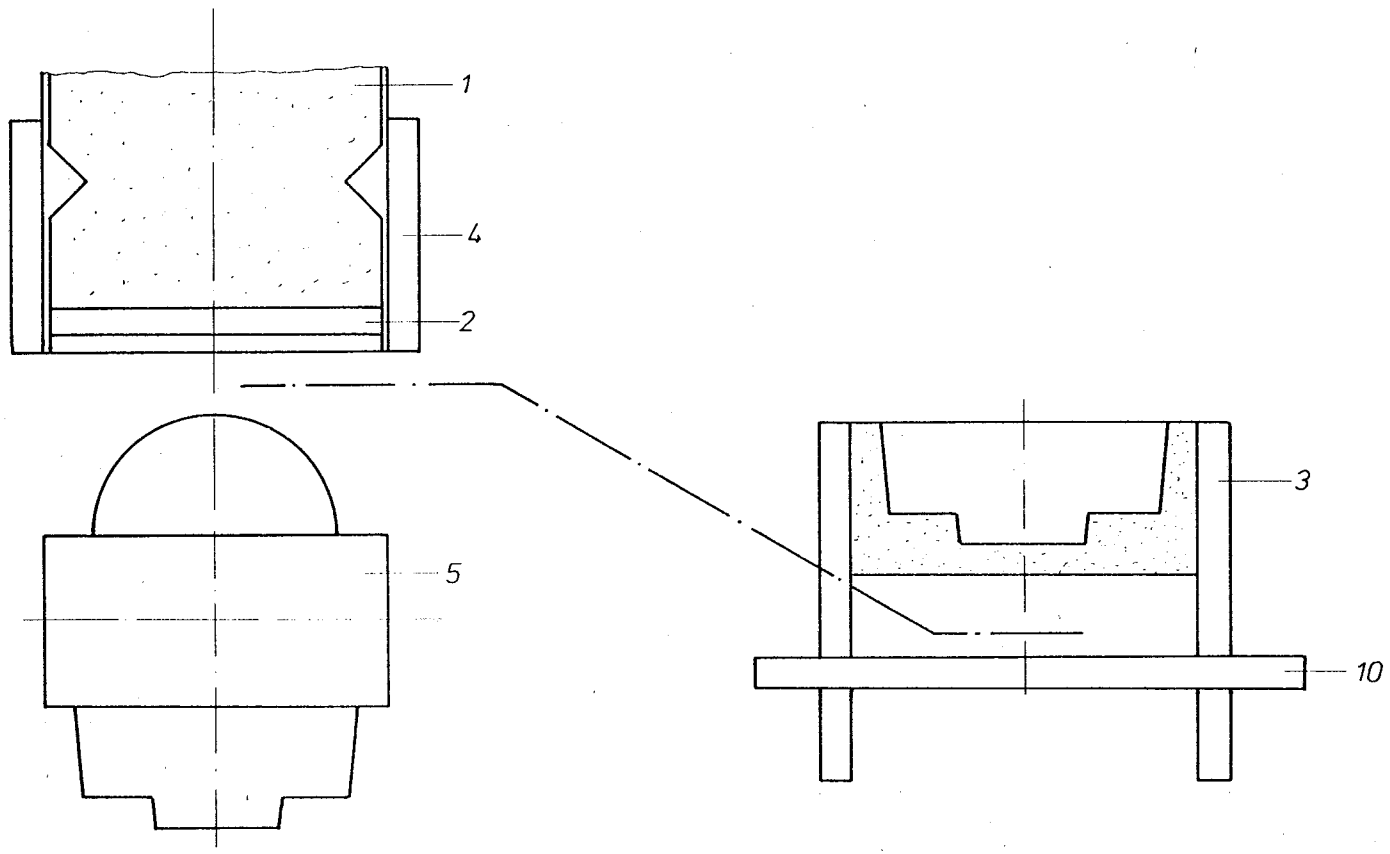
FIG. 3 shows the position after rollover of the pattern plate mount and the drag flask in the core placing station.

For the production of a flaskless block mold the first step—starting with the plant in the initial positions to be seen in FIG. 1—is for the drag flask 3 and the cope flask 4 to be moved by their respective cylinder actuators in a downward direction till the lower edge of the drag flask 3 comes into contact with the pattern plate mount 5 and the pattern plate thereon, its top edge or rim being in air-tight contact with the blowing grid air-tight. Then the blowing grid 2 is moved into the open position and the chamber 7 that is at the top is suddenly put under vacuum. The foundry sand blown into the drag flask is further packed if desired using the compressed air pulse packing system as described in the German Pat. No. 2,844,464, such packing or compaction being undertaken by moving down the closed grid, now acting as a squeezing grid like a piston, for mechanical ramming (see FIG. 2). After such pressing, the sand container 1 is lifted taking the mold flasks 3 and 4 with it so far that the drag flask 3 is able to be moved out of the way to the side over the pattern clear of the molding station, it being turned over through 180° before it is put down on the table. The pattern plate mount 5 is turned through 180° as well with the drag mold (see FIG. 3).

Figure 5:
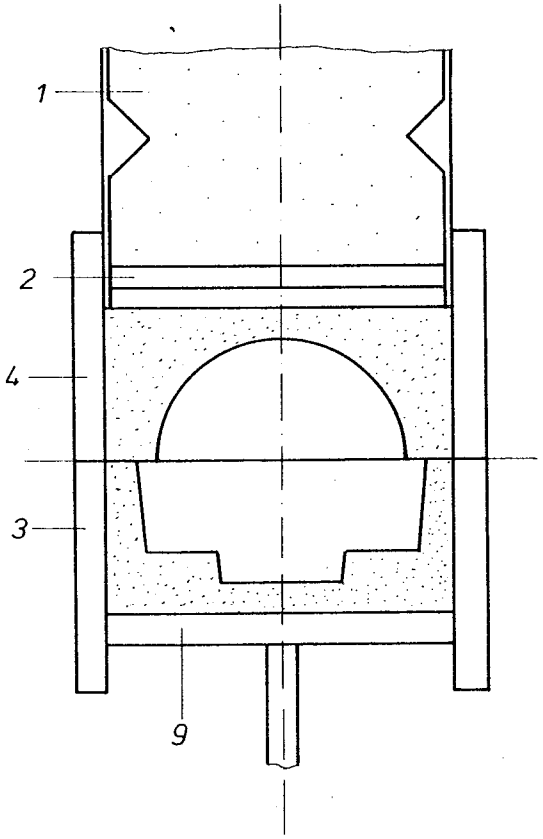
FIG. 5 shows the position in which the mold is closed but before taking off the flasks.
Figure 4:
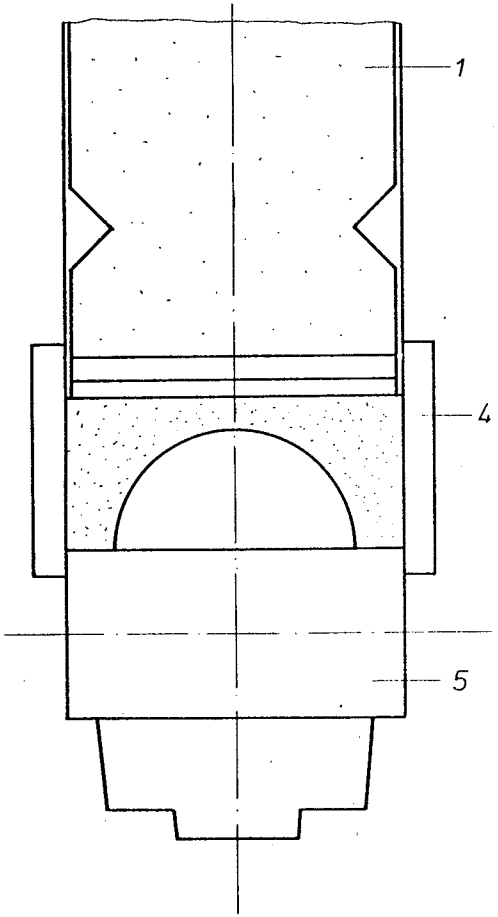
FIG. 4 shows the position after packing the cope
Figure 6:
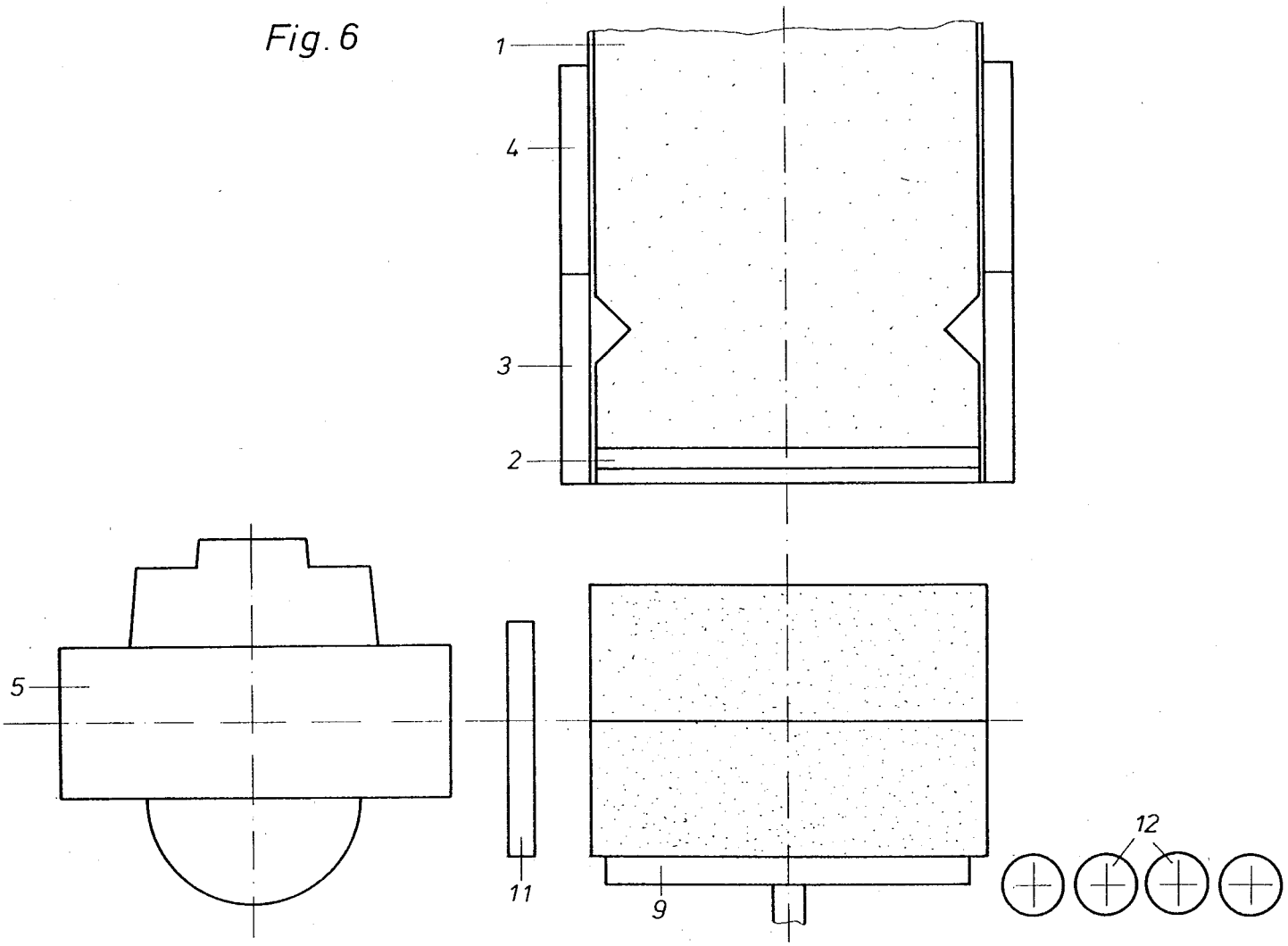
FIG. 6 shows the position before ejecting the finished mold structure on the roller conveyor.

For production of the cope, the cope flask 4 is advanced into the position viewed in FIG. 4 and filled with sand in the same way as noted. The sand is further compacted and the flask lifted clear of the pattern. Then the pattern plate is turned over and moved into one of the positions marked in broken lines in FIG. 7 to the side from the molding station. Such positions are determined by the amount of space available in the foundry. Nextly the drag flask, in which the cores will now have been placed, is pushed under the cope flask and pressed thereagainst by the vertically moving table 9 (see FIG. 5). For stripping the flasks 3 and 4 from the mold they are moved further upwards into the position of FIG. 6, the pressing grid being held thereagainst. After ejecting the flaskless block mold using the thrust plate 11, lowering the table 9 and moving the pattern plate mount 5 back into place in the molding station, the parts of the apparatus will be in the starting position as in FIG. 1.

I claim:

1. A mold making plant with a mold making station for the production of flaskless molds for wet-casting foundry sand, said plant comprising a sand supply container, a blowing and squeezing grid at a lower end of said container, said grid being able to be moved vertically, a mold making flask means, a hollow pattern plate mount, valve and duct means connected with the said mount, said mold making flask means being made up of a cope flask and a drag flask, the cope flask when empty being placed over the drag flask and around said sand container in the manner of a cylinder around a piston.

2. The mold making plant as claimed in claim 1 wherein said mold making machine comprises a roll-over means for the said pattern plate mount and a roll-over means for the said drag flask.

3. The mold making plant as claimed in claim 2 comprising a core insertion unit adjacent to said molding station, said insertion unit functioning for the support of such a rolled over drag flask prior to the production of the cope flask.

4. The mold making plant as claimed in claim 1 comprising a parting wall dividing said hollow pattern plate mount internally into at least two chambers.

5. The mold making plant as claim in claim 1 comprising a vertically moving table under said pattern plate mount.

6. The mold making plant as claimed in claim 1 comprising a conveyor for support of block molds as produced by the plant while casting and cooling is taking place, and a thrust plate for the transfer of closed block mold as produced by the plant onto said conveyor.

7. The mold making plant as claimed in claim 1 further comprising means for moving the drag flask containing the drag therein into contact with the cope flask, that is engaged with the sand container, and for moving the flasks into a position surrounding the sand container along the axis thereof in order to strip the flasks from the drag and cope.

8. A mold making plant for the production of flaskless molds from wet-casting foundry sand comprising a sand supply container, a blowing and squeezing grid at a lower end of said container, said grid being able to be moved vertically, a mold making flask means, a hollow pattern plate mount, valve and duct means connected with the said mount, said mold making flask means being made up of a cope flask and a drag flask, the cope flask when empty being placed over the drag flask fittingly around said sand container in the manner of a cylinder around a piston.

* * * * *